US005368052A

United States Patent [19]

Finamore

[11] Patent Number: 5,368,052

[45] Date of Patent: Nov. 29, 1994

[54] HAIRPIECE

[75] Inventor: Paul V. Finamore, Chicago, Ill.

[73] Assignee: Hairline Creations, Inc., Chicago, Ill.

[21] Appl. No.: 101,370

[22] Filed: Aug. 2, 1993

[51] Int. Cl.[5] ..... A41G 5/00

[52] U.S. Cl. ..... 132/54; 132/53

[58] Field of Search ..... 132/53, 54, 56, 201; 112/80.02, 156

[56] References Cited

U.S. PATENT DOCUMENTS

| | | | |
|---|---|---|---|
| 3,421,521 | 1/1969 | Rich, Jr. . | |
| 3,435,831 | 4/1969 | Nakayama et al. . | |
| 3,613,695 | 12/1968 | Kazdin . | |
| 3,626,954 | 12/1971 | Ostrom . | |
| 3,716,065 | 2/1973 | Finamore | 132/53 |
| 3,970,092 | 7/1976 | Nelson | 132/53 |
| 4,188,894 | 2/1980 | Matsumura | 112/156 |
| 4,453,555 | 6/1984 | Finamore | 132/53 |
| 4,456,019 | 6/1984 | Finamore | 132/53 |
| 4,517,999 | 5/1985 | Finamore | 132/53 |
| 4,606,359 | 8/1986 | Palumbo et al. . | |
| 4,799,502 | 1/1989 | Kobayashi et al. | 132/53 |
| 4,825,886 | 5/1989 | Allen | 132/53 |

*Primary Examiner*—Gene Mancene
*Assistant Examiner*—Frank A. LaViola
*Attorney, Agent, or Firm*—Trexler, Bushnell, Giangiorgi & Blackstone, Ltd.

[57] ABSTRACT

There is disclosed a hairpiece comprising a molded, flexible, plastic foundation member covered by a sheet of net material having spaced-apart cross-elements. The foundation member has a large central opening therein traversed by said net material. A group of hairs is provided having double knots tied around cross-elements of the net material traversing said central opening so as to be freely movable back and forth. Other groups of hairs are secured to the foundation member for providing a natural looking part, and for covering edges of the hairpiece foundation.

3 Claims, 2 Drawing Sheets

FIG. 4
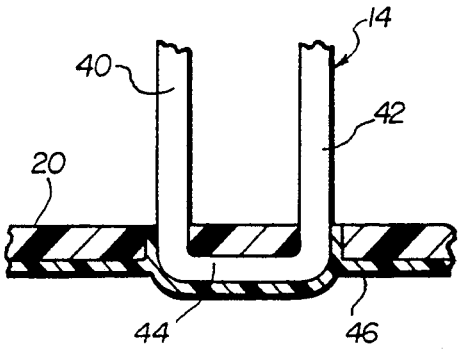
FIG. 5
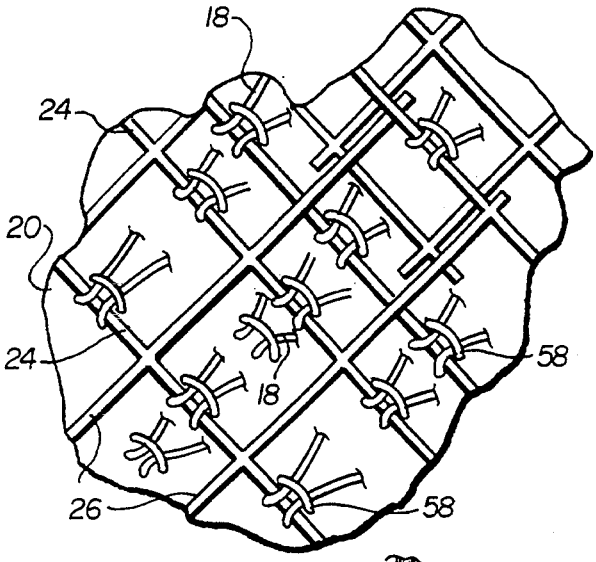
FIG. 6
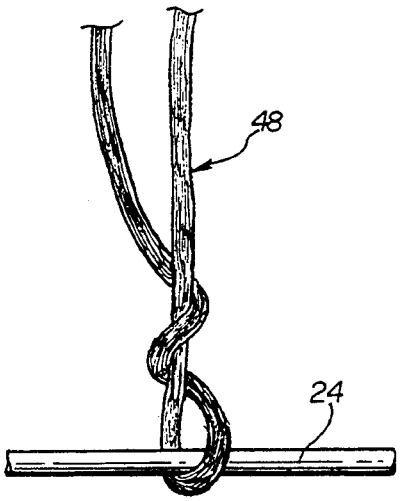
FIG. 7
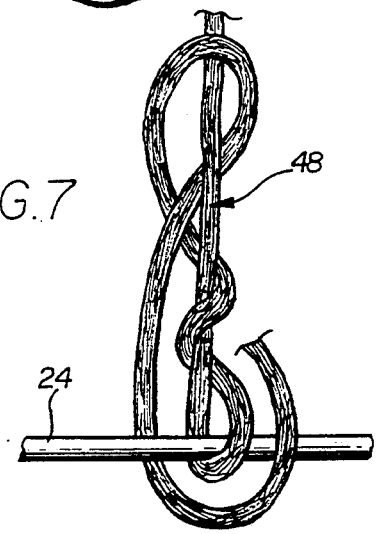
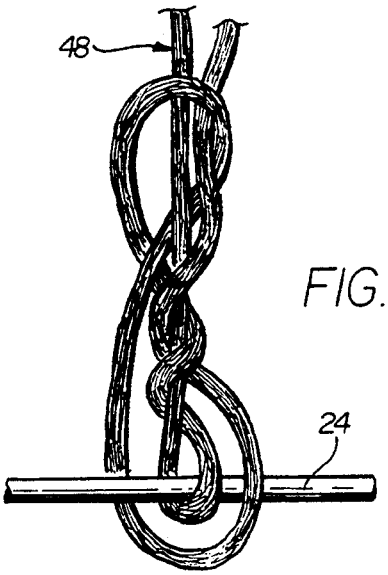
FIG. 8
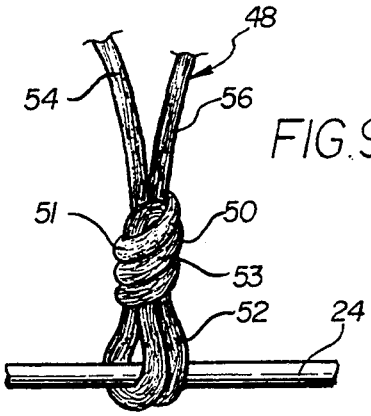
FIG. 9

HAIRPIECE

BACKGROUND OF THE INVENTION

The present invention relates to a hairpiece or hair replacement, and more particularly, to a novel hairpiece of improved appearance, comfort, and cost.

Many different hairpiece structures have heretofore been proposed. Certain of these have attempted to provide an extra natural look, but have been relatively expensive. Others have emphasized economy of construction. Still other prior hairpieces have sought to improve comfort by enhancing the fit or reducing the weight or increasing the resistance to wear. Examples of such prior structures which have been successful are found in U.S. Pat. Nos. 3,716,065; 4,453,555; 4,456,019; and 4,517,999, issued to the present inventor.

SUMMARY OF THE INVENTION

It is an object of the present invention to provide a novel hairpiece constructed for obtaining an improved natural appearance while being relatively economical to produce.

A further object of the present invention is to provide a novel, natural looking hairpiece which has an improved comfortable feel.

Still another object of the present invention is to provide a novel hairpiece of the above-described type which is well ventilated and relatively cool to wear.

Other objects and advantages of the present invention will become apparent from the following description and the accompanying drawings.

A hairpiece constructed in accordance with the present invention comprises a one-piece, flexible, molded, plastic foundation member, conforming to the shape of an area of a head to be covered. An opening defined by marginal portions is provided in the foundation member, which opening is covered by a contoured, net-like member having spaced cross-elements or fibers substantially spaced apart for ventilation. A first group of hairs may be individually secured to a portion of the foundation in a manner which enables them to be combed to provide a natural-looking part. A second group of hairs is knotted around individual cross-elements or fibers of the net material in a manner such that the hairs of the second group may be easily combed or styled in any desired direction or manner. A third group of hairs is economically secured to marginal portions of the foundation member.

BRIEF DESCRIPTION OF THE DRAWINGS

FIG. 4 is a further enlarged fragmentary view of a portion of the hairpiece enclosed in the circle included in FIG. 2;

FIG. 5 is a further enlarged fragmentary plan view of a portion of the hairpiece seen along line 5—5 of FIG. 2; and FIGS. 6 through 9 show successive steps in forming a double knot used for securing a portion of the hairs included in the hairpiece to individual elements or fibers of a net-like member included in the foundation of the hairpiece.

DETAILED DESCRIPTION OF A PREFERRED EMBODIMENT

Figure 1:
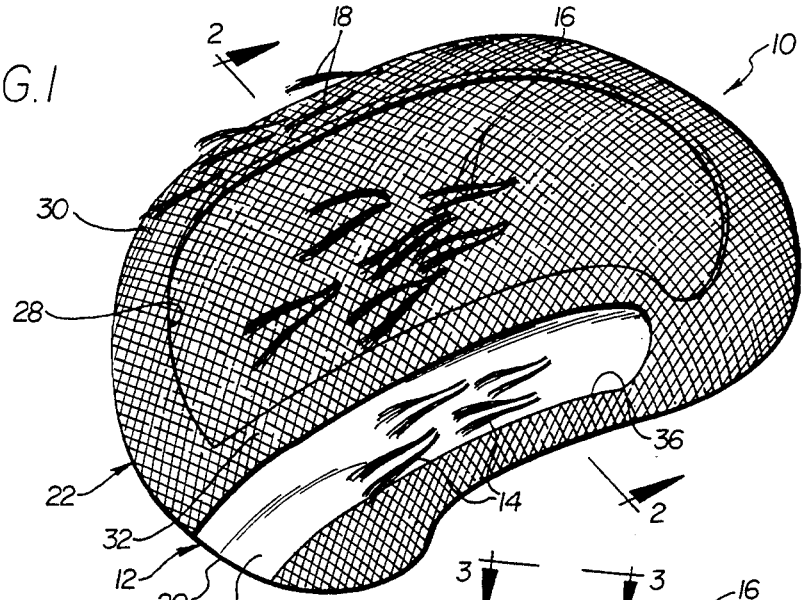
FIG. 1 is a perspective view showing in somewhat simplified form a partially constructed hairpiece incorporating features of the present invention.

Referring now more specifically to the drawings, wherein like parts are designated by the same numerals through the figures, a hairpiece 10 incorporating features of the present invention comprises a foundation 12 to which separate groups 14, 16, and 18 of hairs are secured in the manner and for the purpose described more in detail below. While only a few hairs in each group have been shown so as to simplify the drawing, it is to be understood that sufficient hairs are included in each group so as to provide the desired coverage and appearance.

The foundation 12 comprises a molded base member 20 of flexible, plastic, sheet material. Any suitable, thin, plastic, sheet material which may be molded and which has the desired resistance to body chemicals may be used. For example, sheet material may be formed from polyurethane, and it may be vacuum-molded, as discussed in more detail in the above-cited U.S. Pat. No. 3,716,065, so as to conform to the head of the intended user.

The foundation 12 also includes a member 22 formed of flexible, plastic material of the above-described type, which member 22 is net-like in that it is made up of cross-elements or fibers 24 and 26. The net-like member 22 conforms to the surface of the foundation member 20 and is bonded thereto. Preferably, such bonding is accomplished by painting a layer 25 of a suitable known liquid adhesive over the mesh or net member 22 and marginal portions of the member 20, as indicated in exaggerated form in FIG. 2.

In order to provide ventilation and improved comfort, a large mid-portion of the member 20 is cut away, resulting in an opening 28, defined by marginal portions 30 and 32 of the member 20. It is to be noted that the cross-elements or fibers 24 and 26 of the net member 22 are rather widely spaced to define relatively large apertures or openings 34 therebetween, as compared with a mesh material of the type disclosed in the above-identified U.S. Pat. No. 4,517,999. Since the openings 34 through the net member 22 are large, improved ventilation is obtained. By way of example, it is noted that in a preferred net material 22, the strands or fibers 24 are spaced from each other a distance of about one-eighth of an inch, and the strands or fibers 26 are similarly spaced from each other so that the openings 34 are approximately, but less than, one-eighth of an inch square.

It is to be understood that net materials having openings of different sizes could be used, but the openings should be of sufficient size to provide the desired ventilation, and also to enable hairs or groups of hairs to be tied around individual segments of the strands or fibers 24 or 26, as described below.

Figure 2:
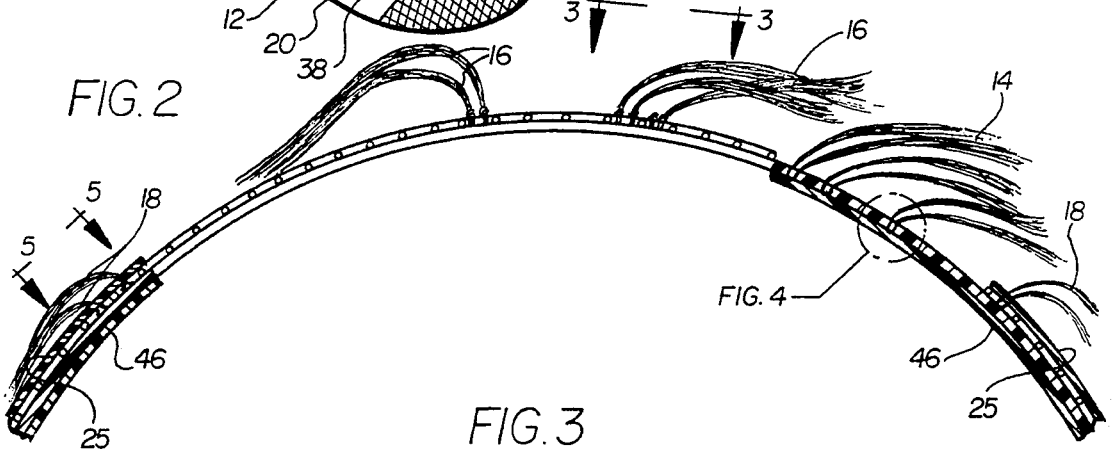
FIG. 2 is an enlarged sectional view taken along line 2—2 in FIG. 1.

As shown in FIGS. 1 and 2, a slot 36 is cut or otherwise formed in the member 22 of net material so as to leave an elongated, narrow section 38 of the foundation member 20 uncovered. The construction is such that the section 38 is positioned at the desired location of the part line to be formed in the final hairpiece. The aforementioned first group of hairs 14 is applied to the section 38 in a manner so that the hair can be combed to present a natural appearing part line in the hairpiece. More specifically, the hairs 14 are applied to the foundation member in the manner fully described and shown in the above-mentioned U.S. Pat. No. 3,716,065. Thus, each hair 14 has opposite end sections 40 and 42 extending outwardly from the base member 20 and joined by a bight portion 44 underlying the base member. In other words, the hairs 14 are sewn to the base member 20 by inserting a needle through the base member and then back upwardly. Preferably, the hairs 14 are secured to the base member 20 by an adhesive layer 46 in the manner disclosed in U.S. Pat. No. 3,716,065 or U.S. Pat. No. 4,456,019. The individual hair segments 40 and 42 projecting upwardly from the base member 20 give the appearance of natural individual hairs projecting from the scalp of the wearer. These individual hairs may be easily combed to provide a desired part.

In accordance with a feature of the present invention, a group 16 of hairs is applied to the portion of the net member 22 overlying the opening 28 in the foundation member 20, as shown best in FIGS. 3 and 6 through 9. More specifically, the hairs 16 are tied to the member in individual groups or bundles 48, which include a plurality of individual hairs. It is to be noted that each bundle 48 is tied to an individual segment of the cross-fibers 24 and/or 26 of the net member. Furthermore, each bundle is tied with a double knot 50 having a first portion 51 and a second portion 53 by the sequence of steps shown in FIGS. 6 through 9, or any other suitable procedure, with the result that the bundle of hairs is formed with a loop 52 surrounding the filament or fiber 24 or 26. Ends 54 and 56 of the bundle of hairs project generally straight outwardly from the knot 50. Furthermore, while the double knot 50 ensures that the bundle of hairs 48 is securely held in place because the knot portions 51, 53 are tight against each other as shown in FIG. 9, the loop 52 surrounds the net element 24 sufficiently loosely so that the bundle is free to pivot back and forth. With this structure, the hairs of the group 16 may be freely combed in any desired direction so that the hairpiece may be styled in much the same manner as natural hair.

Figure 3:
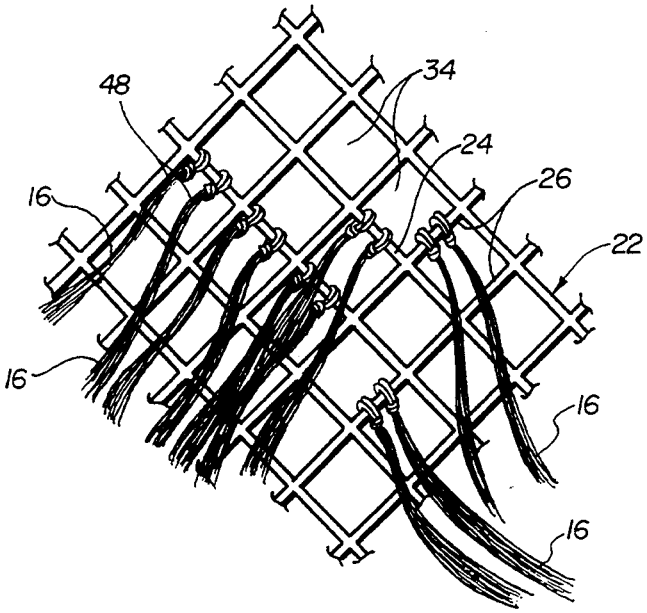
FIG. 3 is a further enlarged fragmentary plan view of the hairpiece viewed from along line 3—3 in FIG. 2.

As shown best in FIG. 3, the bundles 48 of hairs are tied to individual segments of the cross-elements 24 and/or 26. Since these cross-elements are substantially spaced apart from each other, as discussed above, the density of the hair in this portion of the hairpiece may be reduced, if desired, not only for ventilation purposes, but also to provide a natural appearance of a person with somewhat thinning hair.

As shown in FIGS. 1 and 3, the net-like member 22 is arranged so that its cross-fibers 24 and 26 extend generally diagonally with points or corners of the rectangular or diamond-shaped openings 34 facing toward the front of the hairpiece. This arrangement aids in locating the bundles of hair tied to the cross-elements 24 and 26, so that they may be easily combed or styled in any desired direction with respect to the overall hairpiece.

The group 18 of hair includes bundles of a plurality of individual hairs secured to the peripheral or marginal portions of the hairpiece are preferably tied with a single knot 58 of conventional form, as shown best in FIG. 5. As will be understood, such a single knot may be tied more quickly and, therefore, more economically than the double knot utilized with the group 16 of hairs. Furthermore, the group 18 of hairs need not be specifically tied around the elements 24 and 26 of the net-like member. Rather, these hairs may be tied directly through the plastic base member 20 and/or around the individual elements of the net member, as desired and as shown in FIG. 5, in order to obtain the desired hair density. The manner of tying such single knots 58 is well-known in the art. In general, the density of the hair around the margin of the hairpiece may be increased so as to simulate a natural look and also to hide the edge of the hairpiece.

Preferably, the liquid adhesive coating 46, or a coating such as disclosed in the above-mentioned U.S. Pat. No. 4,453,555, is applied to the inner surface of the base member marginal portions 30 and 32 for covering and protecting the portions of the group 18 hairs extending beneath the base member 20, and for providing a smooth surface to enhance the comfort of the hairpiece to the wearer.

As will be understood, the hairpiece may be secured to the scalp of the wearer by utilizing pieces of double-sided tape, not shown, applied to the marginal portions of the base member 20, or by utilizing any other known securing mechanism.

While a preferred embodiment of the present invention has been shown and described herein, numerous changes may be made without departing from the scope of the appended claims.

The invention is claimed as follows:

1. A hairpiece comprising a one-piece, flexible, molded, plastic foundation member conforming to the shape of an area of a head to be covered, said foundation member having a large central opening therethrough bounded by a marginal portion of the member, a sheet of net material having spaced-apart cross-elements defining a multitude of polygonal openings, said sheet being secured to said foundation member and traversing said central opening with many of said polygonal openings registering with said central opening being unobstructed to permit ventilation, said sheet being disposed for leaving an elongated front-to-back extending portion of said foundation member uncovered, a first group of hairs having individual segments extending from said elongated extending portion joined by bight segments extending beneath said foundation member for providing for a natural looking part, a second group of hairs having double knots tied around certain of said cross-elements traversing said central opening and strands extending from said double knots, said double knots having first and second portions tied tightly against each other and loop portions loosely disposed around a single segment of an associated cross-element for enabling the knot and the strands extending therefrom freely to swivel back and forth, and a third group of hairs having single knots tied to said marginal portion of said foundation member.

2. A hairpiece, as defined in claim 1, wherein said cross-elements of said sheet of net material extend generally diagonally of said hairpiece.

3. A hairpiece as defined in claim 1, wherein said second group of hairs includes bundles of hairs tied around certain of said cross-elements by said double knot.

* * * * *